US008878435B2

(12) United States Patent
Demuynck et al.

(10) Patent No.: US 8,878,435 B2
(45) Date of Patent: Nov. 4, 2014

(54) REMOTE THERMAL COMPENSATION ASSEMBLY

(75) Inventors: Randy Demuynck, Wake Forest, NC (US); Curt Progl, Raleigh, NC (US)

(73) Assignee: Cree, Inc., Durham, NC (US)

( * ) Notice: Subject to any disclaimer, the term of this patent is extended or adjusted under 35 U.S.C. 154(b) by 259 days.

(21) Appl. No.: 13/358,938

(22) Filed: Jan. 26, 2012

(65) Prior Publication Data

US 2013/0193850 A1 Aug. 1, 2013

(51) Int. Cl.
*H01J 17/28* (2006.01)

(52) U.S. Cl.
USPC ..... 315/113; 315/118; 362/294; 362/373

(58) Field of Classification Search
USPC ..... 315/113, 117–118, 159, 307; 362/276, 362/294, 373
See application file for complete search history.

(56) References Cited

U.S. PATENT DOCUMENTS

| | | | | |
|---|---|---|---|---|
| 6,964,501 | B2 * | 11/2005 | Ryan | 362/294 |
| 8,186,855 | B2 * | 5/2012 | Wassel et al. | 362/373 |
| 8,246,215 | B2 * | 8/2012 | Lu et al. | 362/294 |
| 2005/0174780 | A1 * | 8/2005 | Park | 362/294 |
| 2006/0022214 | A1 | 2/2006 | Morgan et al. | |
| 2006/0098440 | A1 * | 5/2006 | Allen | 362/294 |
| 2006/0262544 | A1 * | 11/2006 | Piepgras et al. | 362/373 |
| 2008/0123341 | A1 | 5/2008 | Chiu | |
| 2008/0130298 | A1 * | 6/2008 | Negley et al. | 362/365 |
| 2008/0232119 | A1 * | 9/2008 | Ribarich | 362/373 |
| 2008/0273331 | A1 * | 11/2008 | Moss et al. | 362/294 |
| 2009/0109625 | A1 * | 4/2009 | Booth et al. | 361/702 |
| 2009/0161356 | A1 * | 6/2009 | Negley et al. | 362/231 |
| 2010/0060130 | A1 * | 3/2010 | Li | 313/46 |
| 2010/0097806 | A1 | 4/2010 | Kao | |
| 2010/0134016 | A1 | 6/2010 | York et al. | |
| 2010/0171145 | A1 | 7/2010 | Morgan et al. | |
| 2011/0080116 | A1 | 4/2011 | Negley et al. | |
| 2013/0140988 | A1 * | 6/2013 | Maxik et al. | 315/113 |

FOREIGN PATENT DOCUMENTS

| | | | |
|---|---|---|---|
| WO | 2007036871 | A2 | 4/2007 |
| WO | 2008135927 | A1 | 11/2008 |

OTHER PUBLICATIONS

Cree, Inc., International Application No. PCT/US2013/022827, International Search Report and Written Opinion, Mar. 14, 2013.

* cited by examiner

*Primary Examiner* — Jason M Crawford
(74) *Attorney, Agent, or Firm* — Christopher J. Knors; Moore & Van Allen PLLC

(57) ABSTRACT

A thermal compensating circuit board (TCB) assembly comprising a substrate, the substrate comprising at least one thermal compensating circuit deposited thereon, the substrate devoid of a solid state emitter, and at least one electrical connector coupled to the at least one thermal compensating circuit, the connector configured to couple with a solid state emitter assembly and/or power supply. Lighting devices comprising the TCB assembly are provided.

31 Claims, 7 Drawing Sheets

REMOTE THERMAL COMPENSATION ASSEMBLY

TECHNICAL FIELD

The present disclosure is directed to a remotely positioned thermal compensation circuit assembly, and lighting devices comprising same, specifically solid state lighting devices.

BACKGROUND

Although the development of light emitting diodes has in many ways revolutionized the lighting industry, some of the characteristics of light emitting diodes have presented challenges, some of which have not yet been fully met. Efforts have been ongoing to develop lighting devices that are improved, e.g., with respect to energy efficiency, color rendering index (CRI Ra), contrast, efficacy (lm/W), and/or duration of service. In addition, efforts have been ongoing to develop lighting devices that include LED's instead of other forms of light emitters. Ideally, the cost of such lighting devices should be comparable with traditional incandescent lighting to facilitate their acceptance and utilization.

LED light bulbs find application in indoor and outdoor applications, and one particular application of utilizing an LED light bulb is to replace white incandescent light bulbs. The conventional approach utilizing LEDs in light bulbs is to arrange the LEDs on a PCB or other substrate so as to project their light directly towards a lens, such as a dome, diffuser, or a cover.

Current configurations of LED light bulbs, where the LED's and additional circuitry, for example, thermal compensation circuits, are positioned on, or integral with the same board and in the same plane as LED circuitry has limitations in productivity and production flexibility.

SUMMARY

In a first embodiment, a solid state lighting device is provided. The solid state lighting device comprising at least one solid state emitter arranged on a first assembly, and a second assembly arranged about the first assembly, the second assembly comprising thermal compensation circuitry in electrical communication with the first assembly.

In a second embodiment, a thermal compensating circuit board (TCB) assembly is provided. The TCB assembly comprising a substrate comprising at least one thermal compensating circuit deposited thereon, the substrate devoid of a solid state emitter, and at least one electrical connector coupled to the at least one thermal compensating circuit, the connector configured to couple with a solid state emitter assembly and/or power supply.

In a third embodiment, an LED lighting device is provided. The LED lighting device comprising a first assembly comprising a plurality of chip-scale solid state LEDs, and a second assembly comprising a thermal compensation circuit board (TCB) in electrical communication with the plurality of chip-scale solid state LED, and optionally, a third assembly in electrical communication with the first assembly and/or the second assembly.

In a fourth embodiment, a lamp or light fixture comprising the TCB assembly is provided.

DETAILED DESCRIPTION

Figure 1:
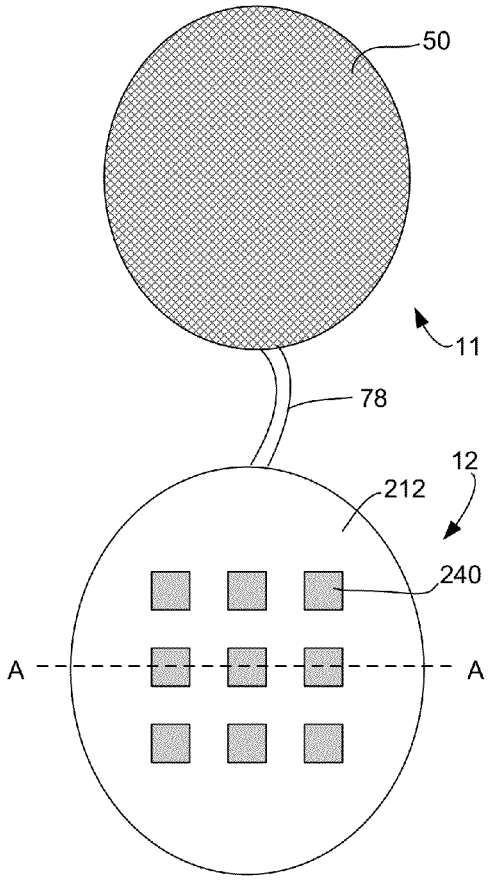
FIG. 1 is a top plan view of an assembly as disclosed and described herein.

The present disclosure relates to a remotely positioned thermal compensation circuit assembly, and lighting devices comprising same, specifically solid state lighting devices. Depending on desired form factor of an LED bulb design, current configurations of LED light bulbs (e.g., where the LED's and additional circuitry, for example, thermal compensation circuits are on the same board and in the same plane as LED circuitry) presents challenges to circuit routing, restricts or limits LED placement, adds complexity to the "optical deck," complicates platform longevity, and limits standardization of the circuitry. The present disclosure provides for separating thermal compensation circuit and/or additional circuits from the LED board. The presently disclosed configurations can alleviate or eliminate packaging constraints, increases LED board space for chip-level LED arrangement and number, reduces the number of components positioned, and allows standarization for the thermal compensation circuitry for a variety of LED lighting devices.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "deposited on" or "on" or extending "onto" another element, it can be directly on or extend directly onto the other element or intervening elements may also be present. In contrast, when an element is referred to herein as being deposited "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The phrase "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The phrase "thermally coupled", as used herein, means that heat transfer occurs between (or among) the two (or more) items that are thermally coupled. Such heat transfer encompasses any and all types of heat transfer, regardless of how the heat is transferred between or among the items. That is, the heat transfer between (or among) items can be by conduction, convection, radiation, or any combinations thereof, and can be directly from one of the items to the other, or indirectly through one or more intervening elements or spaces (which can be solid, liquid and/or gaseous) of any shape, size and composition. The expression "thermally coupled" encompasses structures that are "adjacent" (as defined herein) to one another. In some configurations, the majority of the heat transferred from the light source is transferred by conduction; in other situations or configurations, the majority of the heat that is transferred from the light source is transferred by convection; and in some situations or configurations, the majority of the heat that is transferred from the light source is transferred by a combination of conduction and convection.

The term "adjacent", as used herein to refer to a spatial relationship between a first structure and a second structure, means that the first and second structures are next to each other (for example, where two elements are adjacent to each other, no other element is positioned between them).

The term "assembly," as used herein is inclusive of a sub-assembly. Thus, unless specified, the terms assembly and sub-assembly are used interchangeably.

The phrase "chip-scale solid state emitter" or "chip-scale LED" as used herein refers to an element selected from (a) a bare solid state emitter chip, (b) a combination of a solid state emitter chip and an encapsulant; or (c) a leadframe-based solid state emitter chip package. In certain aspects, "chip-scale" emitter/LED is inclusive of emitter element(s) having a maximum major dimension (e.g., height, width, diameter) of about 2.5 cm or less, more preferably about 1.25 cm or less.

The phrase "thermal compensation circuitry" as used herein refers to any circuit design capable of controlling color shift, temperature, or lumen degradation. Such circuitry can, for example, control temperature by pulsing the solid state emitters. As used herein, the TCB comprises thermal compensation circuitry and optionally other circuits. The intensity of light emitted from some solid state light emitters, as well as their lifetimes varies based on local temperature. The thermal compensation circuitry is deposited on or integral with a thermal compensation board (TCB) or other assembly or sub-assembly. With lighting devices that include light emitting diodes, typically the TCB controls the current or voltage to the chip-scale LEDs. The lower the thermal resistance from the light emitting diode to the environment, the greater light that can be generated from a lighting device without exceeding the optimum maximum junction temperature (or, similar amounts of light can be generated with a lower light emitting diode junction temperature, possibly enabling longer light emitting diode life). The phrase "junction temperature" in this context refers to an electrical junction disposed on a solid state emitter chip, such as a wirebond or other contact. The TCB and optional associated circuitry also provide for adjustment(s) to one or more chip-scale LEDs so as to avoid or eliminate exceeding the maximum junction temperature.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

Conventional solid-state lighting components typically are configured where the thermal compensation circuitry is generally coupled with the heat management path and therefore adversely affects packaging options in compact form factors.

Thermal compensation circuitry is generally more robust than the coupled LED circuitry and therefore, the thermal compensation circuitry typically does not require inclusion in the primary heat management path and/or metal core LED boards. Thus, in one embodiment, thermal comp circuitry is physically removed from the LED board yet in electrical communication therewith. In one aspect, the thermal comp circuitry is removed from the metal core LED board and positioned to at least partially surround the LED board, the thermal compensation circuitry being on a separate PCB (e.g., lower cost fiber glass PCBs), the separate PCB board being separate and apart from the LED board, yet in electrical communication therewith. In yet another aspect, the thermal comp circuitry is removed from the metal core LED board and positioned on a separate PCB (e.g., lower cost fiber glass PCBs), the separate PCB board being separate and apart from the LED board, yet in electrical communication therewith. In the above aspects, the thermal compensation circuitry can be in-plane or out-of-plane with the LEDs and/or the LED board.

The instant application provides improved flexibility in design and space management for solid state lighting devices. Positioning the TCB separate and apart from the LED board offers flexibility in design, especially with the optical deck of the lighting device. In some embodiments, the configuration of separate and apart TCB and LED board components or assemblies may eliminate the need for a UL rated cover for included in the lighting device. With a non-isolated power supply, it is necessary to cover any exposed circuitry so that in the event of failure (i.e. dropping the lighting device or breaking the globe or dome) the user is prevented from touching any exposed circuitry and getting shocked. With the remote thermal compensation circuitry remote from the solid state emitter assembly as disclosed herein, the user of the lighting device can be protected, e.g., in the event of breakage of the device, from accidental exposure to all or most of the active components having a harmful current or voltage, but for the solid state emitters, which are generally low voltage and UL approved (provided they have no exposed traces) without the use of a protective cover on the non-isolated power supply. If design configurations require or provide exposed traces to the solid state emitters, such exposed traces can be covered separately, for example, using Formex or other insulative material over the traces, as opposed to a more complicated and design restrictive plastic cover.

In another embodiment, the thermal compensation circuitry board (TCB) is configured to a non-specific LED board or platform. In this configuration, the TCB can be "standardized" or "modularized." In this configuration, fewer components can be presented on the LED board. Fewer components on the LED board results in more free space to optimize LED placement/LED number and provides for less absorption of reflected light. In this configuration, new releases of LED components/boards can be implemented easier and faster as the LED board itself would be free of constraints typically of related LED boards, thereby increasing platform longevity.

In another embodiment, the TCB assembly can be configured such that is positioned separate and apart from the LED board, for example, with a first side of the TCB parallel with a first side of the LED board, (e.g. mirrored), the LED board configured with or without additional circuitry. For example, the TCB can be in direct contact or deposited onto one side of the LED board. In this configuration, additional layers can be positioned in-between the TCB and LED board. In this configuration, the LED board can be configured to be thermally coupled along outer edge and/or at least a portion of one of its surfaces to a heat sink or thermally conductive base.

In one embodiment, the TCB at least partially surrounds the LED board. The TCB can be substantially co-planar with the LED board or it can be vertically offset from planarity with the LED board.

In one aspect, the TCB is substantially annular. For example, the TCB can be generally circular with an opening sized to receive a LED assembly or LED board of a predetermined size (e.g., diameter) that can be essentially equal to the size of the opening or smaller. In this configuration, for example, the annular TCB may allow a smaller ID LED board to mount or be deposited on and/or thermally couple to a heat sink or other thermally conductive base, e.g., via a raised center pedestal.

All of the components of the TCB can be assembled and/or manufactured using conventional PCB processing techniques or methods. Conventional components can be used, and/or custom components can be employed. The TCB can be configured to be electrically coupled to one or more of a power supply and or the LED board with conventional couplings, e.g., flex connectors, wires, solder, etc. In one embodiment the TCB is a FR4 type board, e.g., absent a metal core. Other PCB board construction and/or materials can be used to fabricate the TCB, such as a two sided FR4 or flexible PCB.

In certain aspects, the present disclosure comprises lighting devices including solid state light emitters as light sources which emit light of different colors which, when mixed, are perceived as the desired color for the output light (e.g., white or near-white). As noted above, the intensity of light emitted by many solid state light emitters, when supplied with a given current, can vary as a result of temperature change. The desire to maintain a relatively stable color of light output while providing sufficient heat transfer management is provided by the lighting device configuration of the present disclosure.

Some embodiments the lighting device can comprise a power line that can be connected to a source of power (such as a branch circuit, a battery, a photovoltaic collector, etc.) and that can supply power to an electrical connector (or directly to the TCB and/or LED board). A power line can be any structure that can carry electrical energy and supply it to an electrical connector on a fixture element and/or to a lighting device.

In some aspects, the lighting device can, in addition to at least one temperature compensation circuit, further include one or more circuitry components, e.g., drive electronics for supplying and controlling current passed through at least one of the solid state light emitters in the lighting device. For example, such circuitry can include at least one contact, at least one leadframe, at least one current regulator, at least one power control, at least one voltage control, at least one boost, at least one capacitor, and/or at least one bridge rectifier, such components being readily designed to meet whatever current flow characteristics are desired for operation of the lighting device.

The lighting device can further comprise any desired electrical connector, a wide variety of which are available, e.g., an Edison connector (for insertion in an Edison socket), a GU-24 connector, etc., or may be directly wired to an electrical branch circuit. In one aspect, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.). In another aspect, some or all of the energy supplied to the plurality of light emitters is supplied by one or more batteries and/or by one or more photovoltaic energy collection device (i.e., a device which includes one or more photovoltaic cells which converts energy from the sun into electrical energy).

In one embodiment, a metallic sheet comprising electrically conductive traces deposited on or over both sides thereof (optionally including intervening dielectric layers) can be employed with the lighting device herein disclosed so as to provide electrical connections to suitably located electrically operable elements associated with the plurality of solid state light emitters, such as the TCB and/or power supply.

In addition to the embodiments and aspects disclosed herein, additional components can be included in the lighting device, such as heat management structures and/or trim elements. Heat management structures include those directly in contact with the light emitting diodes, or with the circuit board on which the light emitting diodes are mounted, and/or the instant TCB. Typical passive thermal solutions, such as extruded or cast heatsinks may be used.

LED Elements

Various embodiments of the present disclosure contemplate the light emitters can be any desired light emitter (or any desired combination of light emitters). The light emitters can consist of a single color of light, or can comprise a plurality of sources of light which can be any combination of the same types of components and/or different types of light emitters, and which can be any combination of emitters that emit light of the same or similar wavelength(s) (or wavelength ranges), and/or of different wavelength(s) (or wavelength ranges).

The lighting device emitters can comprise a solid state light emitter and a luminescent material, for example, a light emitting diode chip, a bullet-shaped transparent housing to cover the light emitting diode chip, leads to supply current to the light emitting diode chip, and optionally a cup reflector for reflecting the emission of the light emitting diode chip in a uniform direction, in which the light emitting diode chip is encapsulated. The luminescent material or phosphor can be dispersed on the LED chip or remotely dispersed so as to be excited with the light that has been emitted from the light emitting diode chip.

In an exemplary embodiment, chip-scale LEDs can be AlGaN and AlGaInN ultraviolet LED chips radiationally coupled to YAG-based or TAG-based yellow phosphor and/or group III nitride-based blue LED chips, such as GaN-based blue LED chips, are used together with a radiationally coupled YAG-based or TAG-based yellow phosphor. As another example, LEDs of group III-nitride-based blue LED chips and/or group-III nitride-based ultraviolet LED chips with a combination or mixture of red, green and orange phosphor can be used. Other combinations of LEDs and phosphors can be used in practicing the present disclosure.

In some embodiments, light emitting diodes can be mounted on a first assembly (a "light emitting diode circuit board"), electrically coupled to a second assembly comprising the thermal compensation circuitry (e.g. "TCB"), and a third assembly comprising electronic circuitry capable of converting AC line voltage into DC voltage, suitable for being supplied to light emitting diodes, can be mounted on a second circuit board (a "driver circuit board"). Line voltage is supplied to the electrical connector and passed along to the driver circuit board, the line voltage being converted to DC voltage suitable for being supplied to light emitting diodes in the driver circuit board, and the DC voltage passed along to the light emitting diode circuit board where it is then supplied to the light emitting diodes. In some embodiments, the first assembly is a metal core circuit board (MCPCB) whereas the second assembly is not a MCPCB. In various embodiments, thermal communication between the plurality of solid state emitters and/or the first assembly can be directed to a heat sink that optionally can be facilitated by one or more active or passive intervening elements or devices. While not illustrated in the figures, thermal grease, thermal pads, graphite sheets heatpipes, thermoelectric coolers, chip-scale heat spreader plates, or other techniques known to those of skill in the art may be used to increase the thermal coupling between the light emitters and/or assemblies and the heat sink and/or between portions or components of these elements. In other aspects, the lighting device is configured without thermal grease, thermal pads, graphite sheets so as to reduce the overall cost of the device.

Heat Management Elements

In one or combinations of aspects presently disclosed, a heat sink can be employed. The heat sink can be made of any suitable desired material, and can be of any suitable shape. In general, the heat sink has high thermal conductivity characteristics, e.g., it has a thermal conductivity. In some aspects, the heat sink can be or contain (or function as) a heat pipe. In other aspects, the heat sink may be provided as or comprise a highly thermally conductive material, such as a metal sheet or strip, a graphite sheet/strip, thermally conductive adhesive or grease, or graphite foam.

Representative examples of materials which are suitable for making a heat sink include, among a wide variety of other materials, aluminum or aluminum alloy, copper, copper alloys, tin, tin alloys, brass, bronze, tungsten, tungsten alloys, steels, vanadium, vanadium alloys, gold, gold alloys, platinum, platinum alloys, palladium, palladium alloys, silver, silver alloys, other metal alloys, liquid crystal polymer, filled engineering polymers (e.g., polyphenylene sulfide (PPS)), thermoset bulk molded compounds or other composite materials and combinations thereof. Each part of the heat sink can be formed of any suitable thermally conductive material or materials, i.e., the entire heat sink can be formed of a single material, combinations of materials, or different portions of the heat sink (e.g., the base or projecting sidewall portions and/or segments of any of these) can be formed of different materials or different combinations of materials, and can be made in any suitable way or ways, e.g., by shaping/stamping. Aluminum and alloys thereof are particularly desirably due to reasonable cost and corrosion resistance, for example, to fabricate the all or part of the heat sink. The LED and/or TCB assemblies can be in thermal contact with the heat sink. Thermal adhesives and/or grease can be used between the assemblies and the heat sink. In other configurations, the heat sink is in direct contact with one or both of the LED and TCB assembly.

Reflector/Trim

The presently disclosed lighting devices may further comprise a fixture element separate or integral with the above heat sink, and/or TCB, and/or plurality of solid state light emitters. The fixture element can comprise a housing, a mounting structure, and/or an enclosing structure. A fixture element, a housing, a mounting structure and/or an enclosing structure made of any of such materials and having any of such shapes can be employed. The lighting device as presently disclosed can include additional components, such as a reflector, trim, and/or downlight can or assembly. In addition, the lighting device can include attachment means for the trim/downlight portions for installation.

In one aspect, to reduce the total cost of the lighting device and/or reduce weight and/or packaging constraints, the reflector and/or trim can be configured of metal, plastic, or a thermally conductive plastic, which can be of integral construction (e.g., "one-piece"). In other aspects, the reflector and/or trim can be separate components configured for assembly prior to installation. Suitable assembly configurations can be used, such as snap-fit or snap-together, and the like. In one preferred aspect, substantially all of the fixture element is constructed of plastic or plastic alloys, optionally a portion of the polymeric trim/reflector elements can be constructed of thermally conductive plastic so as to aid in thermal dissipation.

In some embodiments, one or more structures can be attached to the lighting device which engages structure of the fixture element to hold the lighting device in place relative to the fixture element. In some embodiments, the lighting device can be biased against the fixture element, e.g., so that a flange portion of the trim element is maintained in contact (and forced against) a bottom region of the fixture element (e.g., a circular extremity of a can light housing). For example, some embodiments include one or more spring retainer clips (sometimes referred to as "chicken claws") which comprise at least first and second spring-loaded arms (attached to the trim element) and at least one engagement element (attached to the fixture element), the first and second spring-loaded arms being spring biased apart from each other (or toward each other) into contact with opposite sides of the engagement element, creating friction which holds the trim element in position relative to the fixture element, while permitting the trim element to be moved to different positions relative to the fixture element. The spring-loaded arms can be spring-biased apart from each other (e.g., into contact with opposite sides of a generally C-shaped engagement element), or they can be spring-biased toward each other (e.g., into contact with opposite sides of a block-shaped engagement element). In some embodiments, the spring-loaded arms can have a hook at a remote location, which can prevent the lighting device from being moved away from the fixture element beyond a desired extreme location (e.g., to prevent the lighting device from falling out of the fixture element).

At least one of the portions can be configured to structurally support one or more components of the lighting device, such as a lens and/or reflector, as further discussed below. In one aspect the at least one sidewall portion projects substantially parallel to the principle axis of the lighting device (as defined by a line bisecting the lens/reflector/trim). Such portion(s) may directly contact the outside surface of the lens and/or reflector, or may support the lens and/or reflector with one or more intervening materials.

In some embodiments, the fixture element further comprises a housing suitable for an electrical connector that engages the electrical connector on the lighting device, e.g., the electrical connector connected to the fixture element is complementary to the electrical connector connected to the lighting device (for example, the fixture element can comprise an Edison socket into which an Edison plug on the lighting device is receivable, the fixture element can comprise a GU24 socket into which GU24 pins on the lighting device are receivable, etc.).

Any lighting device in accordance with the present disclosure can comprise one or more lenses/reflectors. Any materials and shapes can be employed in embodiments that include a reflector and/or lens (or plural lenses). The lens can have any desired effect on incident light (or no effect), such as focusing, diffusing, etc. In embodiments in accordance with the present disclosure that include a lens (or plural lenses), the lens (or lenses) can be positioned in any suitable location and orientation.

The inventive subject matter may be more fully understood with reference to the accompanying drawings and the following detailed description of the inventive subject matter.

FIG. 1 is a top plan view of an exemplary (sub)assembly 10 comprising TCB (sub)assembly 11 connected to solid state emitter (sub)assembly 12. Assemblies 11, 12 can be flexibly connected via electrical connector 78, which can be a flex connector, wire, etc. Assemblies 11, 12 each comprises opposing surfaces and each assembly has a longitudinal axis essentially parallel to the opposing surfaces. While FIG. 1 depicts generally annular assemblies, any geometrically shaped configuration can be used. Shapes can be coordinated between the assemblies 11, 12 to provide for construction of a lighting device. Circuits, leads, traces, etc., (not shown) on TCB assembly 11 can be arranged in any pattern as needed. Solid state emitter assembly 12 can contain any number or color of emitters 242, arranged in any pattern. Openings in or through the opposing surfaces and/or perimeter edge of the sub-assemblies 11, 12 can be employed to configure the source of current to the respective assemblies or to establish electrical communication between the assemblies. As shown, and in one embodiment, assembly 12 is devoid of a thermal compensation circuit(s) and the TCB assembly 11 is devoid of solid state emitter(s).

Figure 2:
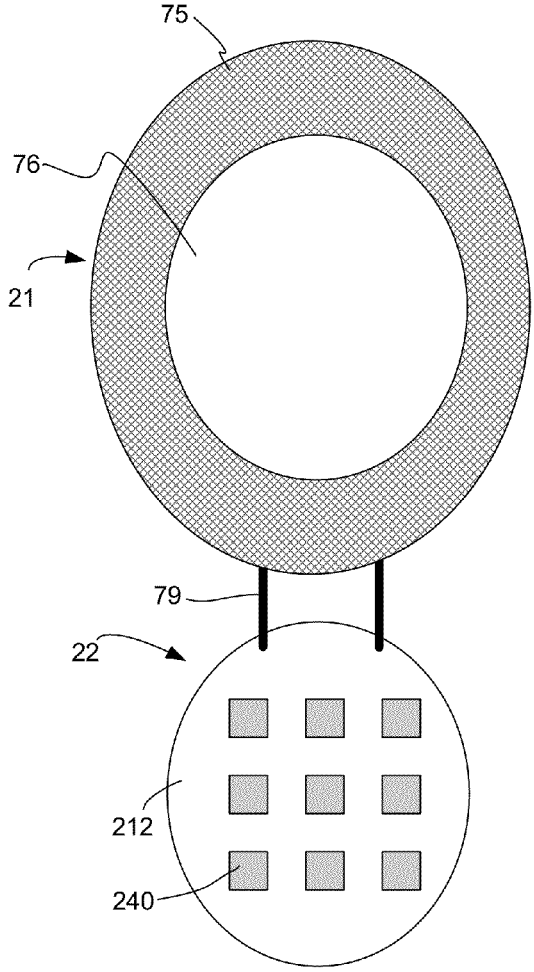
FIG. 2 is a top plan view of an alternate assembly as disclosed and described herein.

FIG. 2 is a top plan view of an alternate exemplary assembly 20, comprising TCB (sub)assembly 21 connected to solid state emitter (sub)assembly 22. Assemblies 21, 22 each comprises opposing surfaces and each assembly has a longitudinal axis essentially parallel to the opposing surfaces. Assemblies 21, 22 can be flexibly connected via electrical connector (s) 79, which can be a flex connector, wire, etc. Circuits, leads, traces, etc., (not shown) on TCB assembly 21 can be arranged in any pattern as needed. Solid state emitter assembly 22 can contain any number or color of emitters 242, arranged in any pattern. Assembly 21 comprises opening 76. Opening 76 can be sized to accommodate assembly 22. While FIG. 2 depicts assembly 21 with a generally annular opening, any geometrically shaped opening can be used. Opening 76 can be coordinated between the assemblies 21, 22 to provide for "coded" construction of one type of TCB with a particular solid state emitter assembly (or standardized). As shown, and in one embodiment, assembly 22 is devoid of a thermal compensation circuit(s) and the TCB assembly 22 is devoid of solid state emitter(s).

Figure 3A:
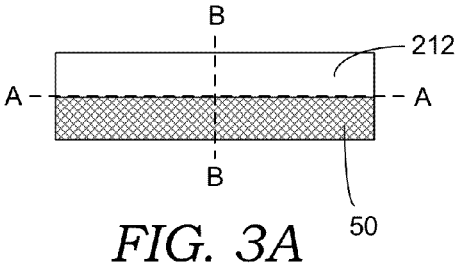
FIGS. 3A, 3B, and 3C are partial sectional views of alternate arrangements of the embodiment of FIG. 1 as disclosed and described herein.
Figure 3B:
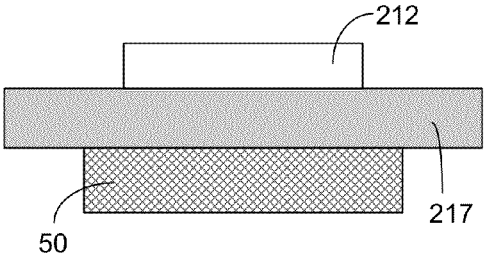
Figure 3C:
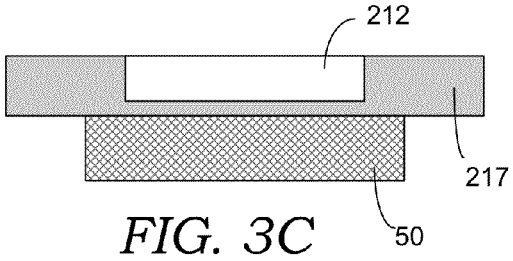

FIGS. 3A, 3B, and 3C are partial sectional views of possible, non-limiting arrangements of the embodiment similar to that of FIG. 1. In FIGS. 3A-3C, TCB assembly 50 is adjacent (e.g., mirrored) to solid state emitter (also referred to as LED) assembly 212. Longitudinal axis of PCB assembly 50 (parallel to line A-A) is vertically offset from (along line B-B) and parallel to the longitudinal axis of LED assembly 212. In FIG. 3A, TCB assembly 50 directly contacts at least a portion of LED assembly 212. In FIGS. 3B and 3C, the assemblies 50, 212 are separated by heat sink 217 or other thermally conductive material. In FIG. 3C, edges of LED assembly 212 contact heat sink 217. Thermal grease/adhesives can be used between the assemblies 50, 212 and heat sink 217.

Figure 4A:
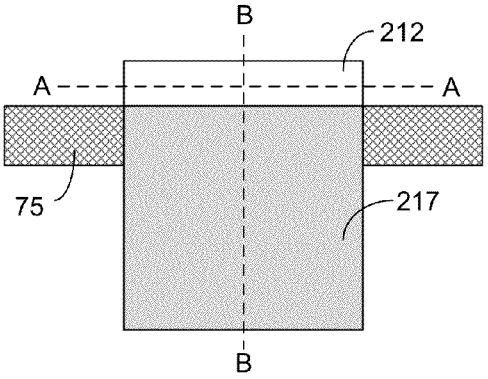
FIGS. 4A, 4B, and 4C are partial sectional views of alternate arrangements of the embodiment of FIG. 2 as disclosed and described herein.
Figure 4B:
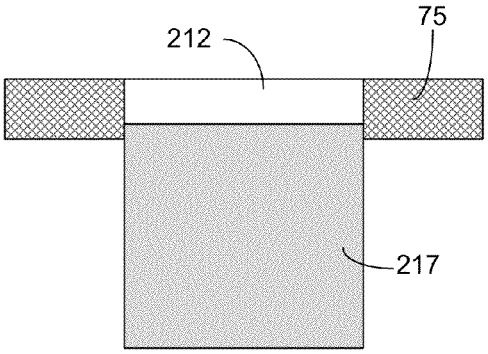
Figure 4C:
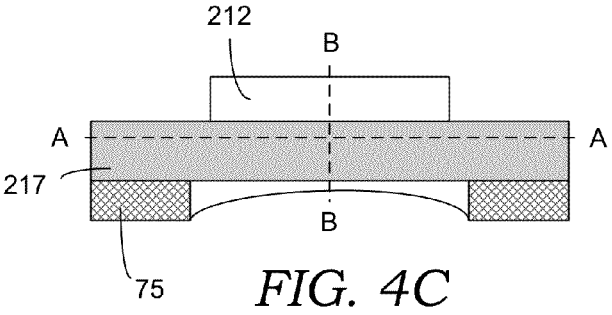

FIGS. 4A, 4B, and 4C are partial sectional views of alternate arrangements of the embodiment of FIG. 2. In FIGS. 4A and 4B, TCB assembly 75 is shown generally annular and is adjacent to LED assembly 212. In these configurations, LED assembly 212 can sit on a raised, centered pedestal (e.g., heat sink 217). Further, n these configurations, TCB assembly 75 can surround LED assembly 212. In one aspect, e.g., as shown in FIG. 4B, the longitudinal axis of TCB assembly 75 is shown coplanar with the longitudinal axis of LED assembly 212. In another aspect, e.g., as shown in FIG. 4*c*, longitudinal axis of PCB assembly 75 (parallel to line A-A) is vertically offset from (along line B-B) and parallel to the longitudinal axis of LED assembly 212. Thermal grease/adhesives can be used between the assemblies 75, 212 and heat sink 217.

Figure 5:
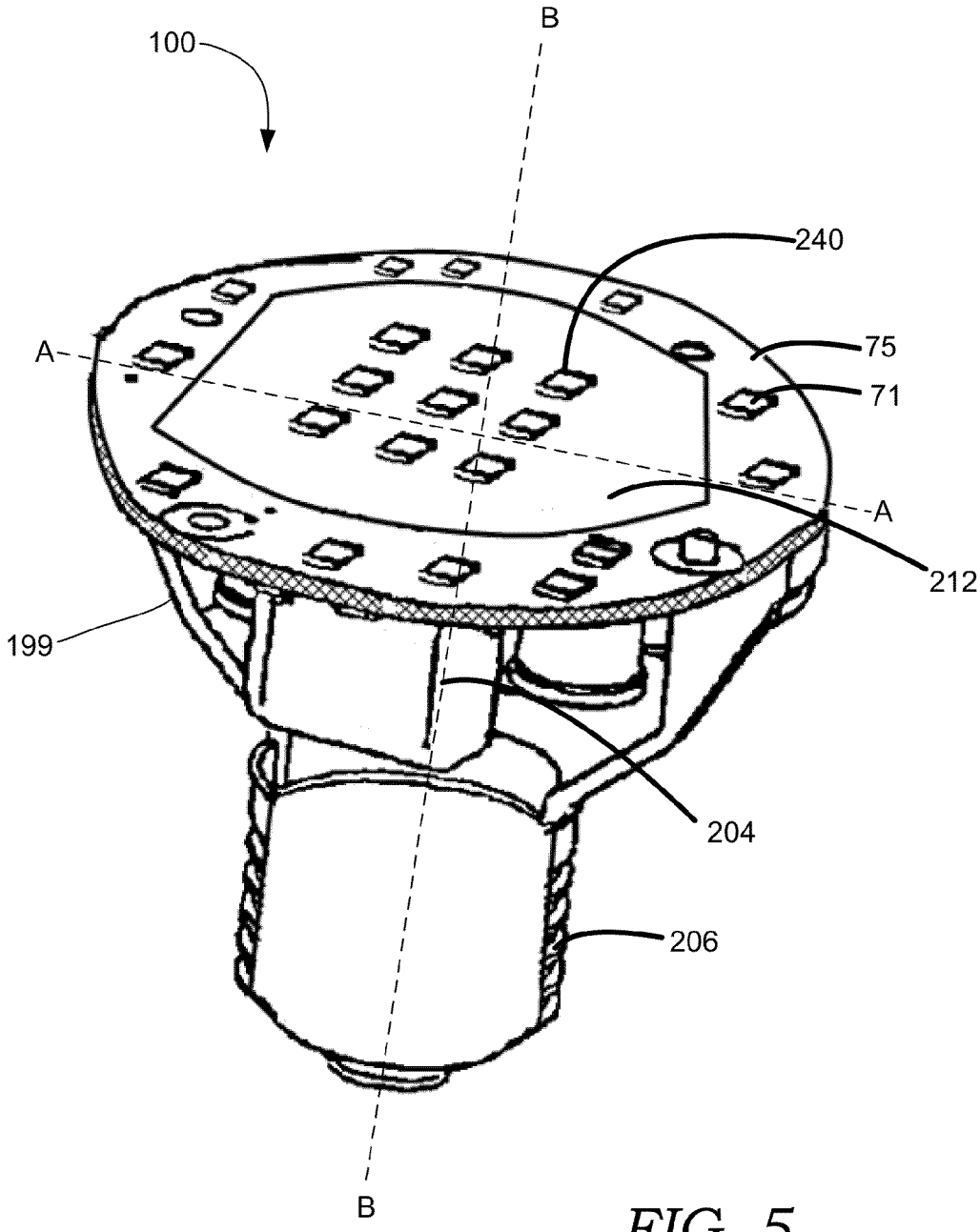
FIG. 5 is a side (partial sectional) perspective view of a lighting device fixture with the assembly embodiment similar to that of FIG. 2.

FIG. 5 is a side (partial sectional) perspective view of exemplary lighting device 100 with the assembly embodiment similar to that of FIG. 2. Thus, TCB assembly 75 rests on or is supported by housing 199, TCB assembly surrounding LED assembly 212 and comprises at least temperature compensation circuitry 71. Various additional components, e.g., power supply 204, can be configured within housing 199 to feed current to either or both assemblies 75, 212. Power can be supplied via standard Edison socket 206 assembled to housing 199. Alternate arrangements of the various additional components can be employed. Likewise, TCB assembly 75 opening 76 can be of any geometrical shape. LED assembly can be raised above the surface of TCB assembly (e.g., on heat sink pedestal), to improve illumination profile of device 100.

Figure 6:
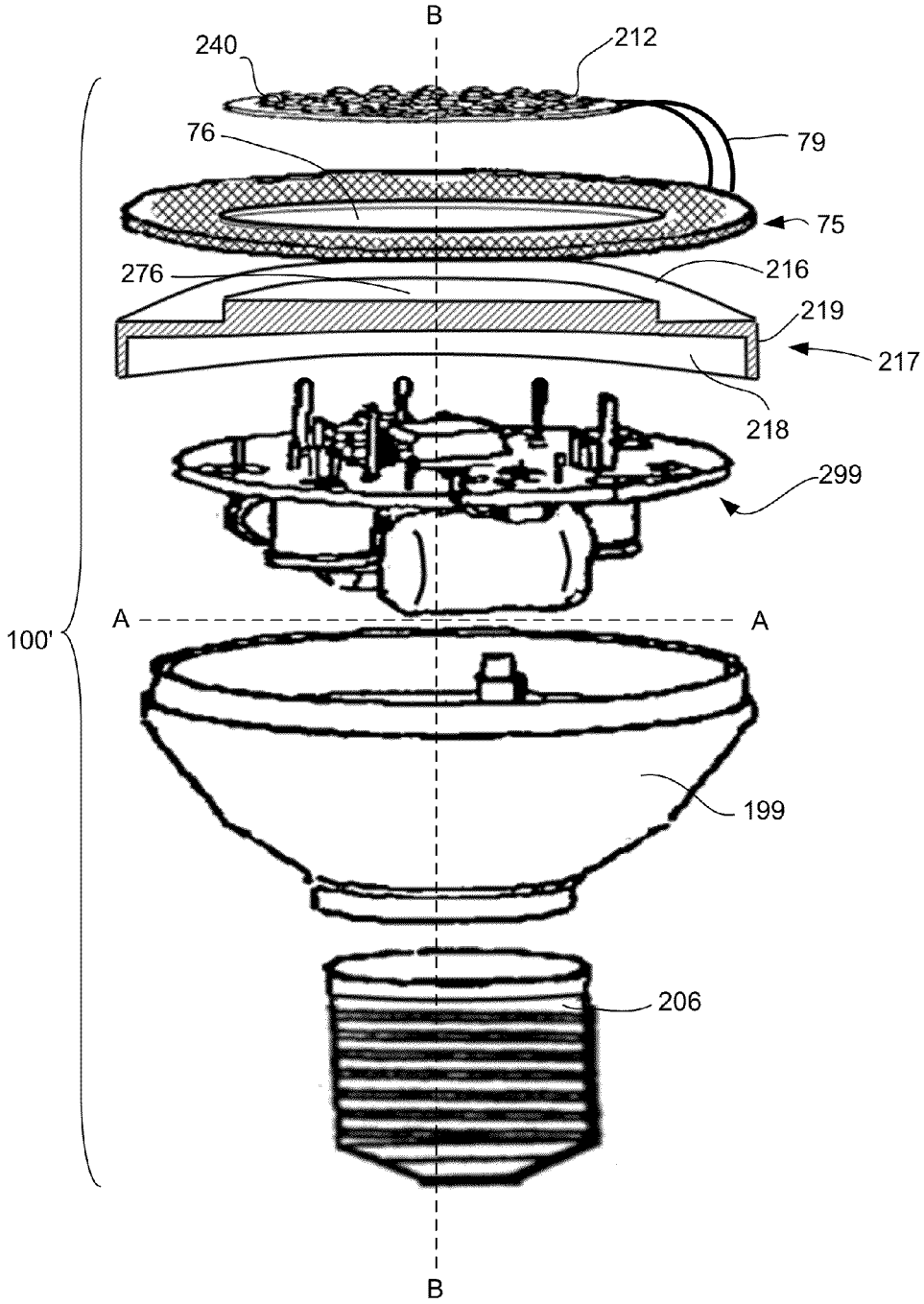
FIG. 6 is an exploded side perspective view of a lighting device fixture with the assembly embodiment similar to that of FIG. 2 as disclosed and described herein.

FIG. 6 is an exploded side perspective view of device 100' similar to that of lighting device 100. TCB assembly 75 can be configured to receive LED assembly 212 in opening 76 and/or mount on posts or other alignment features of housing 199 or third component (e.g., driver assembly) 299. Either or both assemblies 75, 212 can be thermally coupled (or directly coupled) to heat sink 217. Heat sink 217 is shown in partial sectional view and is depicted as having a surface 216 with projecting wall 219 configured to assemble with housing 199, surface 216 having raised pedestal 276 generally accommodating opening 76 of TCB assembly 75. Heat sink 217 can be constructed from metal, thermally conductive polymer or thermally conductive composite material, as discussed above, and can be formed, for example, by molding, stamping, or die casting.

Figure 7:
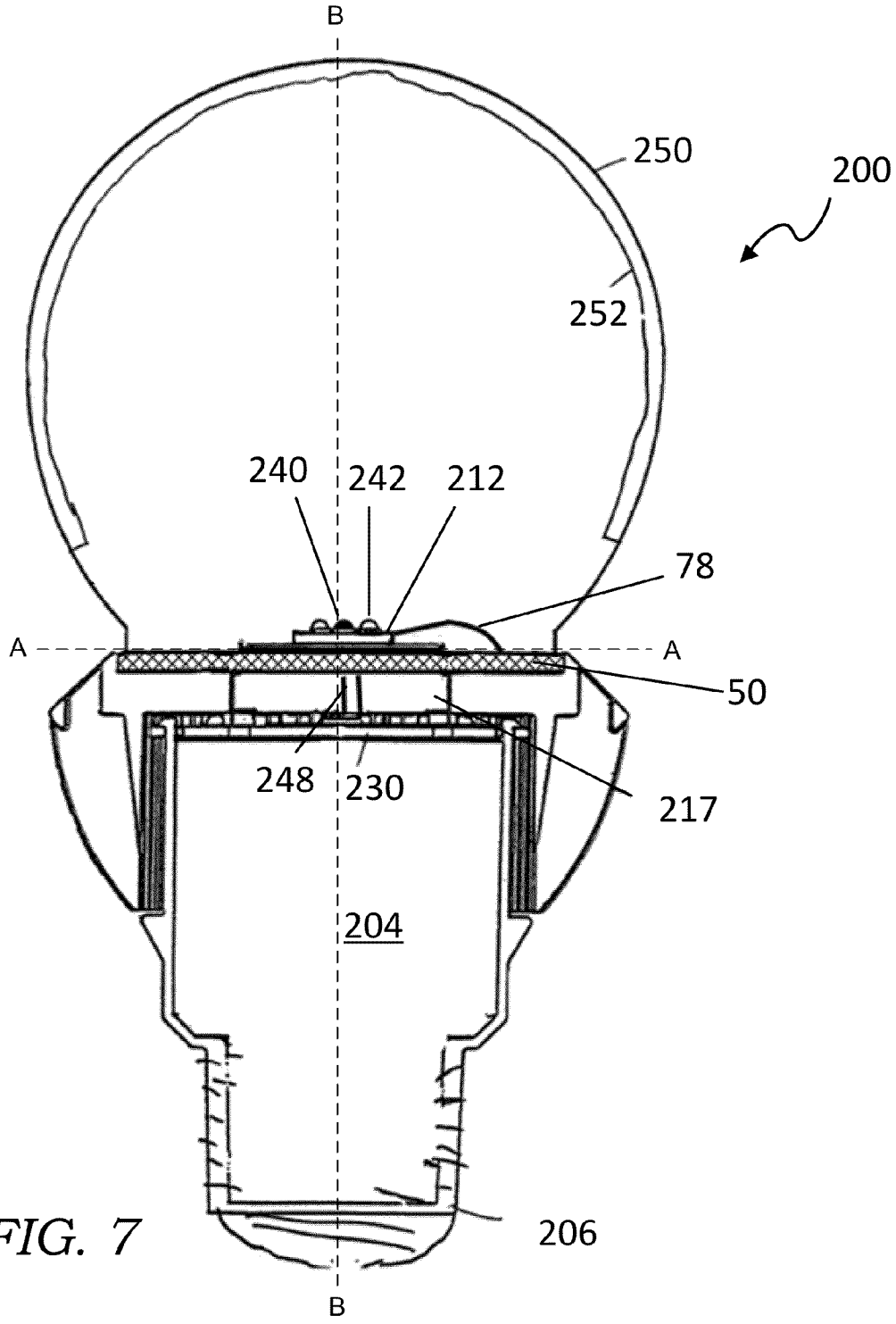
FIG. 7 is a side (partial sectional) perspective view of a lighting device fixture with the assembly embodiment similar to that of FIG. 1 as disclosed and described herein.

FIG. 7 is a side (partial sectional) perspective view of lighting device 200 with the assembly embodiment similar to that of FIG. 1. FIG. 7 shows a side view of device 200, which can be configured for omni-directional or uni-directional illumination. FIG. 7 shows LED assembly 212 having chip-scale modules 242 (that may be first solid state emitters and/or second solid state emitters), interconnected to TCB assembly 50 via flexible connector 78, optionally with additional wires 248 to power supply 204 of the device. By way of example, the particular power supply portion of an LED device 200 shown in FIG. 7 includes an Edison socket 206. The Edison base can engage with an Edison socket so that this example LED device 200 can replace a standard incandescent bulb. The electrical terminals of the Edison base are connected to the power supply to provide AC power to the power supply. LED assembly 212 can include multiple LED modules mounted on a carrier such or other substrate/submount, which provides both mechanical support and electrical connections for the LEDs. Heat sink 217 and optional thermal isolation device 230 are provided. The heat sink design can vary, for example, the heat sink may have more extended curved fins, more or fewer fins, etc. A heat sink may be provided that has a more decorative appearance.

Still referring to FIG. 7, LED assembly 212 can comprise, for example, LED packages or LED modules, in which an LED chip is encapsulated inside a package with a lens and leads. Lens can have diffusing properties and can have phosphor in or on the lens. Each LED module is mounted in LED assembly 212. The LED modules can include LEDs operable to emit light of two different colors. LED assembly can comprise, for example, nine LED packages or LED modules, in which an LED chip is encapsulated inside a package with a lens (and/or diffuser) and leads. Device 200 of FIG. 7 is shown with a single diffuser 250 with phosphor 252 coated on inner surface of diffuser 250, or alternatively, elsewhere. The exterior surface of diffuser 250 may be frosted, painted, etched, roughened, may have a molded in pattern, or may be treated in many other ways to provide color mixing for the device. Diffuser 250 may be made of glass, plastic, or some other material that passes light as disclosed above.

Figure 8:
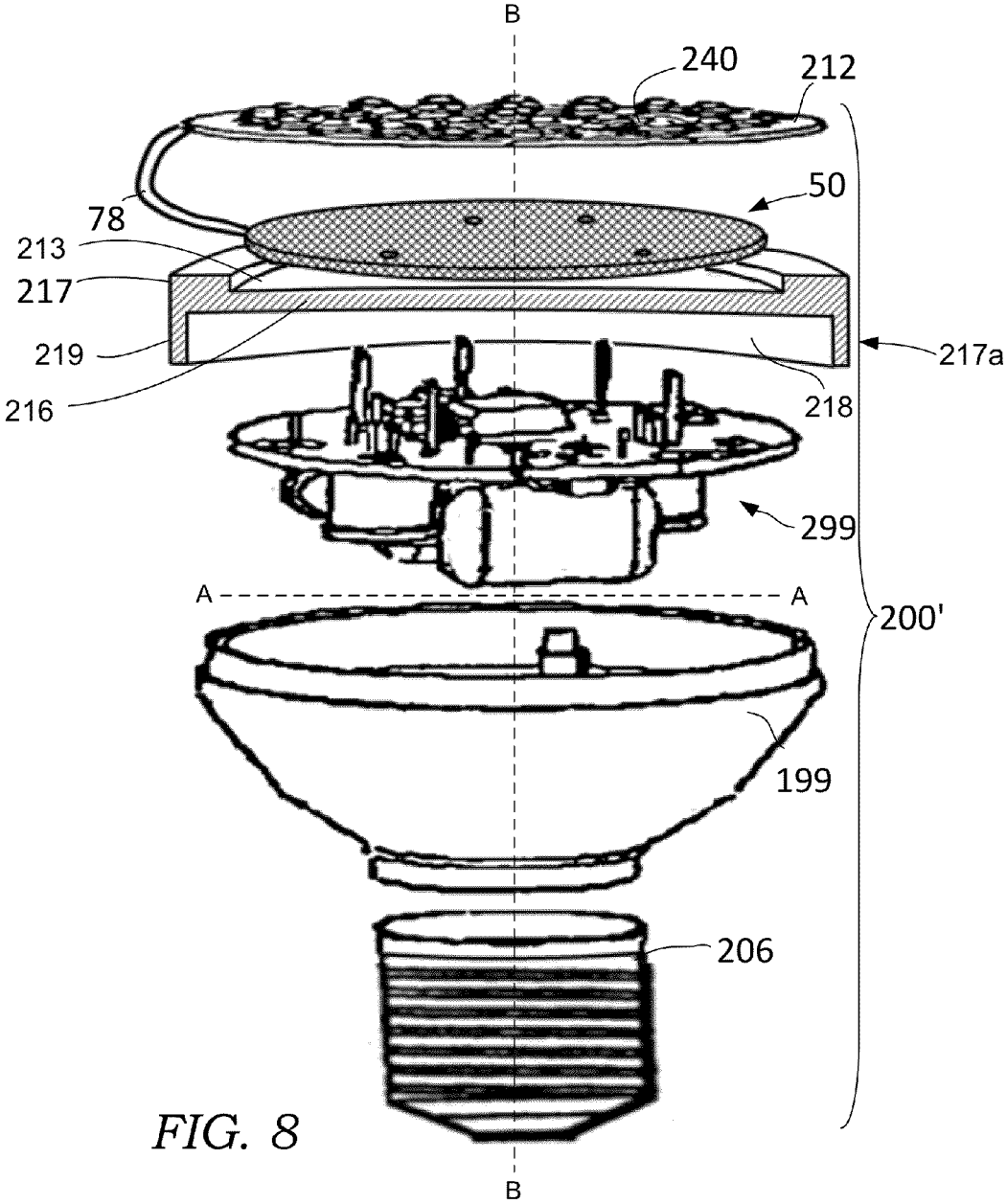
FIG. 8 is an exploded side perspective view of a lighting device fixture with the assembly embodiment similar to that of FIG. 1 as disclosed and described herein.

FIG. 8 is an exploded side perspective view of lighting device 200', which is similar to that of device 200, with LED assembly 212 connect via connector 78 to TCB assembly 50. TCB assembly 50 can be configured of slightly smaller diameter (or surface area) to that of LED assembly 212. TCB assembly 50 can be sized to be received by heat sink 217*a* such that the at least one surface and/or perimeter of TCB assembly is in contact (or direct contact) with heat sink 217*a*. Heat sink 217*a* is shown in alternate configuration similar to that shown for device 200. Heat sink 217*a* is shown in partial sectional view and is depicted as having surface 216 with projecting wall 219 configured to assemble with housing 199, surface 216 having recess 213 generally accommodating the perimeter of TCB assembly 50. Surface of TCB assembly 50 can be flush with, recessed, or raised relative to surface 216 of heat sink 217*a*. Heat sink 217*a* can be constructed from metal, thermally conductive polymer or thermally conductive composite material, as discussed above, and can be formed, for example, by molding, stamping, or die casting.

The thermal compensation circuitry includes, in at least one exemplary embodiment, a thermal sensor that is configured to provide a temperature signal corresponding to an operating condition of the solid state lighting apparatus, and a control circuit that is configured to receive the temperature signal and to selectively interrupt electrical current to all or a portion of the solid state emitters responsive to the temperature signal including a value that exceeds a high temperature limit. The control circuit can be further configured to change a visible appearance of light emitted from the lighting device via the selective interruption of electrical current to at least a portion of the solid state light emitters. Some embodiments provide that the control circuit is further configured to interrupt electrical current that is provided by a power supply device to the lighting device.

Figure 9:
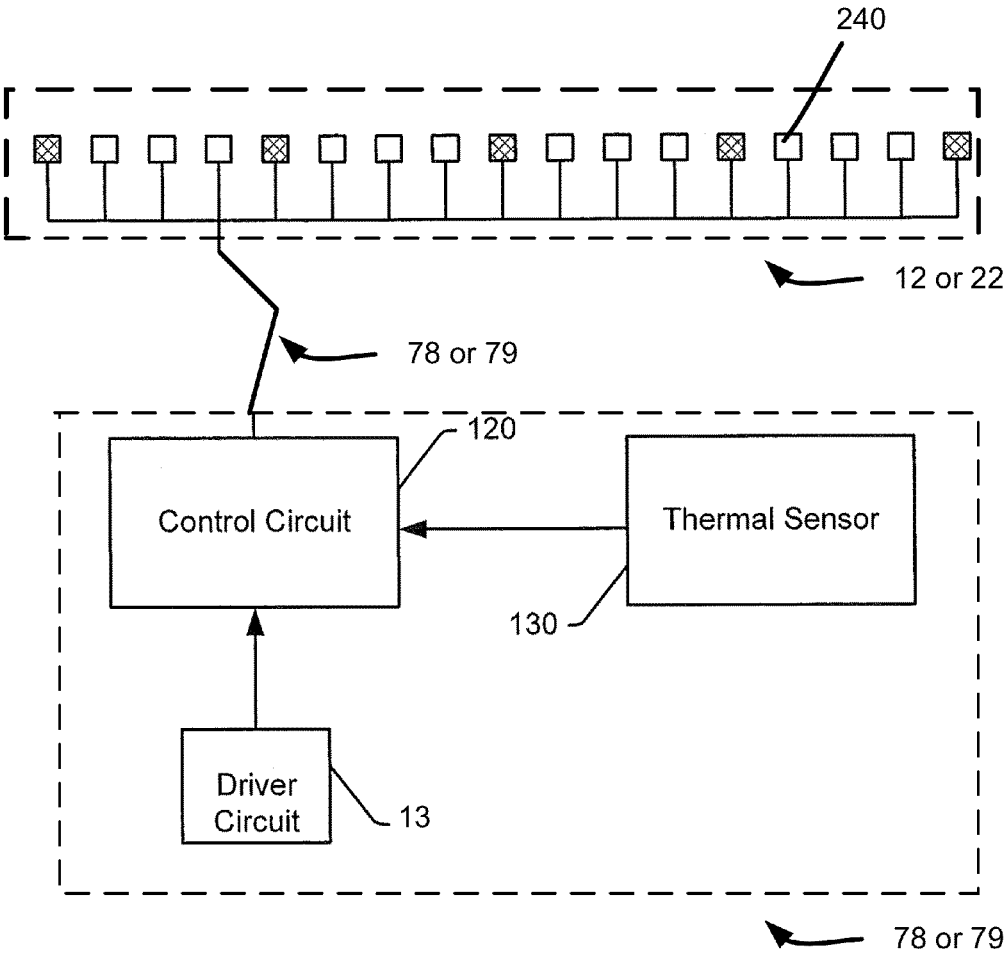
FIG. 9 is a block diagram illustrating a solid state emitter assembly and temperature compensating circuit as disclosed and described herein.

Reference is now made to FIG. 9, which is a block diagram illustrating solid state emitter assembly 12 or 22, shown without a thermal compensation circuit, coupled via connector 78 or 79 to TCB assembly 50 or 75, shown without a solid state emitter (similar to FIGS. 1 and 2) with solid state emitter driver circuit 13 according to some embodiments. Lighting devices 100 or 200 may include multiple solid state light emitters (e.g., diodes, light emitting diodes, LEDs, etc.) 110. Lighting devices 100 or 200 may include a control circuit 120 that is configured to receive electrical current from a LED driver circuit 13, which may or may not be part of the lighting device. Thus, in some embodiments, the solid state emitter assembly can be separately provided to a device and/or system manufacturer to be used in an application and/or environment, the characteristics of which may be unascertainable to the solid state emitter assembly supplier. Likewise, the solid state emitter assembly supplier may lack knowledge regarding application and/or environmental conditions that may exceed a design and/or test standard corresponding to the TCB assembly. For example, a solid state emitter assembly may be rated to include an operating life that is dependent on specific operating conditions, such as, for example, temperature, which can "modularized" so as to be coupled to a custom or a generic TCB assembly (or vice versa). The device and/or system may be designed to include the driver circuit 13 as a separate device/system component.

Still referring to FIG. 9, to detect and/or indicate one or more operating conditions that exceed those designated by a solid state emitter assembly manufacturer, thermal sensor 130 that is configured to provide a temperature signal corresponding to an operating condition of the lighting device 100 or 200. In some embodiments, an operating temperature may include a junction temperature corresponding to one or more of the light emitters 240. Some embodiments provide that an operating temperature may include an ambient temperature corresponding to an operating environment. Thermal sensor 130 may include a thermistor, a resistance temperature detector (RTD), and/or a thermocouple, among others. Control circuit 120 may be configured to receive the temperature signal from thermal sensor 130 and selectively interrupt electrical current to a portion of light emitters 240. For example, if a value of the temperature signal exceeds a high temperature limit, electrical current to one or more of a first light emitters may be interrupted to cause the first light emitters to turn off. Once the first light emitters are turned off, the characteristics of the light emitted from the lighting device 100 or 200 may be determined solely by the characteristics of one or more second light emitters, which may continue to operate. For example, the first light emitters can be BSY and the second light emitters can be red, interrupting the electrical current to the first light emitters may cause the lighting device 100 or 200 to emit substantially red light. Accordingly, some embodiments provide that the control circuit 120 is configured to change the visible appearance of the light emitted from the lighting device 100 or 200 responsive to a high temperature operating condition.

In some embodiments, control circuit 120 may be further configured to continue to receive and/or update a temperature signal from thermal sensor 130 even after a high temperature condition is detected and the first light emitters are turned off. If, after interrupting electrical current to the first light emitters, the value of the temperature signal decreases, indicating a reduction in the operating temperature, the electrical current may be resumed to the first light emitters. In some embodiments, a restore function temperature value may be defined to trigger the restoration of the electrical current to the firs light emitters. For example, a restore function temperature value may be less than the high temperature limit such that a hysteresis control characteristic may be provided.

Some embodiments provide that control circuit 120 may include comparator functions and/or devices for comparing the received temperature signal to the high temperature limit and/or the restore function temperature. In some embodiments, outputs from the comparator functions and/or devices may be received by latching circuits including bistable multivibrator circuits, among others. For example, in some embodiments a set-reset (SR) flip-flop may be used to change, set, and/or maintain an output state corresponding to a value of the temperature signal relative to the high temperature limit and/or the restore function temperature.

Some embodiments provide that control circuit 120 is configured to intermittently interrupt the electrical current to the first light emitters. For example, in some embodiments, more than one high temperature limit value may be provided and the control circuit may be configured to interrupt the current at a first interval corresponding to a first high temperature limit and a second interval corresponding to a second high temperature limit. In some embodiments, the current interruption may be alternating with non-interrupted intervals to create an on/off sequence. For example, in response to the temperature signal exceeding the first high temperature limit, control circuit 120 may be configured to interrupt the electrical current to the first light emitters for a first predetermined time (e.g., ten second) duration for a second predetermined time duration (e.g., twenty seconds). Alternatively, in response to the temperature signal exceeding the second high temperature limit, control circuit 120 may be configured to interrupt the electrical current to the first light emitters for a one second duration every two seconds. In some embodiments, the first high temperature limit may correspond to an emitter junction temperature and/or the second high temperature may correspond to an ambient temperature, among others. In this manner, a visible appearance of the lighting device 100 or 200 may change in different ways, e.g., to signal different respective operating conditions.

Either PCB or LED assembly can comprise a printed circuit board (PCB), alumina, sapphire or silicon or any other suitable material, such as T-Clad thermal clad insulated substrate material, available from The Bergquist Company of Chanhassen, Minn. For PCB embodiments, different PCB types can be used independently for the TCB and/or LED assemblies, such as standard FR-4 PCB, metal core PCB, or any other type of printed circuit board. It is to be appreciated that size (including thickness), shape, and conformation of FR4 board may be varied from the designs illustrated herein within the scope of the present disclosure.

Lighting devices 100 and 200, and the sub-assemblies and/or components thereof can be assembled in any other suitable way. Any two or more structural parts of the lighting devices described herein can be integrated. Any structural part of the lighting devices described herein can be provided in two or more parts (which may be held together in any known way, e.g., with adhesive, screws, bolts, rivets, staples, snap-fit, etc.).

The present disclosure is applicable to lighting devices of any size or shape capable of incorporating the described heat transfer structure, including flood lights, spot lights, and all other general residential or commercial illumination products. For example, the remote thermal compensation embodiments presently disclosed are generally applicable to a variety of existing lighting packages, for example, CR6, LR4, and LR6 downlights, XLamp products XM-L, ML-B, ML-E, MP-L EasyWhite, MX-3, MX-6, XP-G, XP-E, XP-C, MC-E, XR-E, XR-C, and XR LED packages manufactured by Cree, Inc.

Furthermore, while certain embodiments of the present disclosure have been illustrated with reference to specific combinations of elements, various other combinations may also be provided without departing from the teachings of the present disclosure. Thus, the present disclosure should not be construed as being limited to the particular exemplary embodiments described herein and illustrated in the Figures, but may also encompass combinations of elements of the various illustrated embodiments and aspects thereof.

We claim:

1. A solid state lighting device comprising:

at least one solid state emitter arranged on a first assembly devoid of thermal compensation circuitry; and a second assembly devoid of the at least one solid state emitter, the second assembly arranged about the first assembly, the second assembly comprising thermal compensation circuitry in electrical communication with the first assembly wherein the second assembly contacts at least a portion of the first assembly.

2. The solid state lighting device of claim 1, wherein the second assembly is adjacent to the first assembly.

3. The solid state lighting device of claim 2, wherein the surface corresponding to the longitudinal axis of the second assembly having the thermal compensation circuitry is coplanar with the surface corresponding to the longitudinal axis of the first assembly having the at least one solid-state emitter.

4. The solid state lighting device of claim 1, wherein the longitudinal axis of the second assembly is vertically offset from and parallel to the longitudinal axis of the first assembly.

5. The solid state lighting device of claim 1, wherein the second assembly directly contacts at least a portion of the first assembly.

6. The solid state lighting device of claim 1, wherein the second assembly surrounds the first assembly.

7. The solid state lighting device of claim 6, wherein the surface corresponding to the longitudinal axis of the second assembly having the thermal compensation circuitry is coplanar with the surface corresponding to the longitudinal axis of the first assembly having the at least one solid-state emitter.

8. The solid state lighting device of claim 1, wherein the surface corresponding to the longitudinal axis of the second assembly having the thermal compensation circuitry is vertically offset from and parallel with the surface corresponding to the longitudinal axis of the first assembly having the at least one solid-state emitter.

9. The solid state lighting device of claim 1, wherein the first assembly is deposited on the second assembly.

10. The solid state lighting device of claim 1, wherein the first assembly is deposited on a heat sink and the second assembly at least partially surrounds the heat sink.

11. The solid state lighting device of claim 1, further comprising a third assembly in electrical communication with the first assembly and/or the second assembly, wherein the third assembly comprises at least one of a power supply, a leadframe, a current regulator, a power control, a voltage control, a solenoid, a boost, a capacitor, and a bridge rectifier.

12. The solid state lighting device of claim 1, wherein the first assembly comprises a metal core printed circuit board and the second assembly comprises a non-metal core printed circuit board.

13. The solid state lighting device of claim 1, further comprising a heat sink in thermal contact with the first assembly.

14. The solid state lighting device of claim 1, wherein the second assembly at least partially surrounds the heat sink.

15. A thermal compensating circuit board (TCB) assembly comprising:

a substrate comprising at least one thermal compensating circuit deposited thereon, the substrate devoid of a solid state emitter; and at least one electrical connector coupled to the at least one thermal compensating circuit, the connector configured to couple with a solid state emitter assembly and/or power supply wherein the substrate comprises an opening sized for receiving an LED assembly and/or a heat sink.

16. The assembly of claim 15, wherein the substrate comprises opposing surfaces, the substrate configured for receiving an LED assembly on one of the opposing surfaces.

17. The assembly of claim 15, wherein the electrical connector is a flex connector.

18. The assembly device of claim 15, further comprising a solid state emitter assembly flexibly coupled to the substrate via the electrical connector.

19. The assembly of claim 15, wherein the substrate comprises at least one aperture configured to receive at least one electrical conductor for operatively connecting to a power supply.

20. An LED lighting device comprising:

a first assembly comprising a plurality of solid state LEDs; and a second assembly comprising a thermal compensation circuit board (TCB), the second assembly being separate and apart from and adjacent to the first assembly and in electrical communication with the plurality of solid state LEDs; and optionally, a third assembly in electrical communication with the first assembly and/or the second assembly.

21. The LED lighting device of claim 20, wherein the first assembly is devoid of a thermal compensation circuit and the second assembly is devoid of the plurality of solid state LEDs.

22. The LED lighting device of claim 20, wherein the respective surfaces, corresponding to the thermal compensation circuit board and the plurality of solid state LEDs along their respective longitudinal axes of the first assembly and the second assembly, respectively, are in a coplanar arrangement.

23. The LED lighting device of claim 20, wherein the surface corresponding to the longitudinal axis of the second assembly having the thermal compensation circuit board is vertically offset from and parallel with the surface corresponding to the longitudinal axis of the first assembly having the solid state LEDs.

24. The LED lighting device of claim 20, wherein the first assembly comprises a metal core printed circuit board (MCPCB) and the second assembly is a non-metal core printed circuit board.

25. The LED lighting device of claim 20, further comprising a housing supporting the first assembly and the second assembly, the housing configured to contain at least one of ballast, circuit driver, PCB board, a screw base connector, and an electrical plug connector.

26. A device comprising:

at least one solid state emitter arranged on a first assembly;

a second assembly separate from the first assembly, the second assembly comprising thermal compensation circuitry in electrical communication with the first assembly and a heat sink;

wherein the second assembly is positioned between the first assembly and the heat sink.

27. The device of claim 26, wherein the first assembly is devoid of a thermal compensation circuit and the second assembly is devoid of the at least one solid state emitter.

28. The device of claim 26, wherein the second assembly is adjacent to the first assembly.

29. The device of claim 26, wherein the second assembly at least partially surrounds the first assembly.

30. The device of claim 26, wherein the first assembly is deposited on the second assembly.

31. The device of claim 26, wherein the first assembly is deposited on a heat sink and the second assembly at least partially surrounds the heat sink.

* * * * *